US005936507A

United States Patent [19]

Borck et al.

[11] Patent Number: 5,936,507

[45] Date of Patent: Aug. 10, 1999

[54] BAYONET-TYPE FUSE HOUSING ASSEMBLY HAVING A VENT TUBE

[75] Inventors: Gordon Thomas Borck; David William Beitz, both of Waukesha, Wis.

[73] Assignee: Cooper Industries, Inc., Houston, Tex.

[21] Appl. No.: 09/094,584

[22] Filed: Jun. 15, 1998

[51] Int. Cl.[6] ..... H01H 85/042; H01H 85/02; H01H 85/22

[52] U.S. Cl. ..... 337/204; 337/205; 337/252; 361/835

[58] Field of Search ..... 337/204, 205, 337/252, 251, 253, 254, 210, 211, 280, 194, 186; 361/104, 626, 642, 835, 837

[56] References Cited

U.S. PATENT DOCUMENTS

| | | | |
|---|---|---|---|
| 1,972,958 | 9/1934 | Steinmayer et al. | 200/114 |
| 2,003,616 | 6/1935 | Steinmayer et al. | 200/135 |
| 2,160,926 | 6/1939 | Triplett et al. | 200/120 |
| 2,918,557 | 12/1959 | Link | 337/194 |
| 3,244,838 | 4/1966 | Astleford, Jr. | 337/224 |
| 3,365,616 | 1/1968 | Hermann | 361/41 |
| 3,781,746 | 12/1973 | Cuzzone | 337/204 |
| 4,010,437 | 3/1977 | Macemon et al. | 337/204 |
| 4,220,941 | 9/1980 | Mahieu et al. | 337/250 |
| 4,365,227 | 12/1982 | Trayer | 337/202 |
| 4,628,291 | 12/1986 | Lien | 337/203 |
| 4,628,292 | 12/1986 | Muench et al. | 337/204 |
| 4,791,394 | 12/1988 | Mikulecky | 335/174 |
| 5,204,654 | 4/1993 | Hay | 337/204 |
| 5,227,758 | 7/1993 | Ranjan | 337/204 |
| 5,576,682 | 11/1996 | Fisher et al. | 337/186 |

*Primary Examiner*—Leo P. Picard
*Assistant Examiner*—Anatoly Vortman
*Attorney, Agent, or Firm*—Fish & Richardson PC

[57] ABSTRACT

A fuse housing assembly having a fuse holder housing for receiving a fuse holder. The fuse housing is mountable to a transformer tank that holds a dielectric liquid. When the fuse holder and fuse are inserted into the fuse housing that is mounted to the transformer tank, the fuse is located under the dielectric oil. The fuse holder assembly includes a vent tube that communicates a gas above the level of the dielectric liquid in the transformer to the interior of the fuse holder housing. When an operator removes the fuse holder to replace an exhausted fuse, a seal formed between the fuse holder and the fuse holder assembly is broken, and pressurized gas within the transformer tank will vent through the vent tube, through the interior of the fuse holder housing, and out an open end of the fuse holder housing to atmosphere, rather than causing the dielectric liquid to flow out of the fuse holder housing.

14 Claims, 2 Drawing Sheets

BAYONET-TYPE FUSE HOUSING ASSEMBLY HAVING A VENT TUBE

BACKGROUND OF THE INVENTION

1. Field of the Invention

The present invention relates to fuse housing assemblies, and more particularly, to bayonet-type fuse housing assemblies that receive a fuse for a transformer circuit.

2. Description of the Related Art

In many instances, it is necessary to protect a transformer or an electric circuit from excessive current. For example, a current limiting fuse is typically in series with the transformer circuit and is configured to trip or break at only very high current levels. A bayonet-type fuse assembly is also connected in series with the transformer circuit and is generally configured to trip at current levels smaller than that of the current limiting fuse, although there may be some overlap between the current trip levels of the two current limiting devices. An example of such a bayonet-type fuse assembly is illustrated in U.S. Pat. No. 5,227,758, the entire disclosure of which is hereby incorporated by reference. When current exceeds a specific amperage, the fuse in the bayonet-type fuse assembly located in the transformer body will melt or vaporize and thus break or open the transformer circuit.

Because of the high voltages (7.2, 14.4, 23, 24.9 and 34 KV) associated with transformers, fuses that break the circuit of the transformer are typically located in the transformer and under a dielectric liquid, such as mineral oil, within the transformer. The dielectric liquid provides arc quenching during fuse operation and also prevents arcing between the fuse contacts and the walls of the transformer or other items within the transformer.

In a conventional bayonet-type fuse holder housing for receiving a fuse, a cylindrical housing of electrically insulating material protrudes into the transformer at a downward angle such that a portion of the cylindrical housing is located under the oil located within the transformer. A portion of the cylindrical housing is also located external of the transformer, and protrudes from the transformer. A bayonet-type fuse holder having an attached cartridge with fuse link may be inserted into the interior of the cylindrical housing such that the fuse is located near the most distal end of the housing under the oil and is in contact with a pair of contacts. The portion of the fuse housing located within the transformer body has openings that allow the fuse to be directly exposed to the oil. The bayonet-type holder and cartridge fuse are removable from the fuse holder housing by simply pulling on an end of the bayonet-type fuse holder that protrudes from the portion of the fuse housing that is located external of the transformer body.

During operation of the above-described bayonet-type fuse assembly, it is necessary that the fuse be entirely submerged within the oil such that when operating conditions occur and the fuse operates or melts, any electrical arc between the conductive opposite ends of the fuse will be quickly extinguished by the dielectric oil. Thus, the dielectric oil helps extinguish the arc. The oil also cools equipment within the transformer.

After the fuse has operated, it is necessary that a new fuse be inserted into the fuse holder housing in order to reenergize the electrical circuit to permit the transformer to operate. However, before a new fuse may be inserted into the fuse holder housing, it is necessary that the operated fuse held by the fuse holder be removed from the fuse holder housing such that the operated fuse may be replaced with a new fuse.

To replace the open fuse, it is necessary that an operator remove the bayonet-type fuse holder completely from the fuse holder housing. However, most, if not all, transformer tanks are sealed from the exterior environment to prevent water, moisture, dirt and other contaminants from entering the interior and degrading the dielectric fluid (oil) of the transformer. Because the transformer tank is sealed from the surrounding environment, it is common that the transformer tank becomes pressurized. This increase in pressure primarily occurs because the oil within the transformer tank expands when its temperature is increased. Expansion will occur when the transformer is exposed to sun in warm climates and when the transformer is operating under high load conditions. Thus, it is apparent that the oil level within the transformer tank varies according to operating conditions. The pressure within the tank may also increase because of fuse operation. Temperature variations can cause the oil level to vary approximately 5 inches on a 72 inch high transformer tank.

If the transformer tank is pressurized, upon removal of the bayonet-type fuse from the bayonet-type fuse housing, a seal will be broken, relieving the pressure inside the tank to possibly cause dielectric oil from the interior of the transformer to travel up through the bayonet-type fuse holder housing due to the differential in pressure between the tank and the surrounding atmosphere. In fact, a high velocity liquid stream of hot oil may jet out of the portion of the bayonet fuse holder housing that protrudes from the transformer tank. That is, when the bayonet fuse holder is removed from the fuse holder housing, the tank is no longer sealed and the pressure within the tank will equalize with atmospheric pressure via the fuse holder housing that communicates the interior of the transformer with the exterior environment.

The oil that flows out of the fuse holder housing may be at a high temperature and may injure the operator who has removed the fuse. Under normal operating conditions the oil may be between 90–100° C. (194° F.–212° F.), and under extreme conditions, such as during hot summer days in warm climates and when the transformer has been under full load, the oil may be approximately 120° C. (248° F.).

Because it is necessary that the fuse is located completely under the oil, at all operating temperatures, it is undesirable that none of the oil exit the transformer. If the oil level becomes too low in the transformer tank, the upper contact of the fuse may be exposed to air, causing danger to personnel removing the fuse as an arc between the upper contact and the transformer wall can result.

There have been various attempts to address the above problems. For example, conventional transformer housings attempt to address this problem by providing a pressure relief valve that actuates automatically upon an increase in pressure within the transformer tank. For example, known pressure relief valves typically will bleed at approximately eight pounds per square inch (PSI). Nevertheless, it is common that the transformer is pressurized between atmospheric pressure and the bleed pressure. This pressure is sufficient to cause the dielectric oil to flow from the fuse holder housing when the fuse holder is removed. In some instances, oil has ejected from the housing for approximately 20 seconds while the pressure within the tank equalizes to atmospheric pressure. Some transformer tanks do not include pressure relief valves.

Other transformer tanks include a manually actuatable pressure relief valve that may be manually actuated by an operator to bleed all pressure within the transformer housing prior to removal of the bayonet-type fuse holder from the fuse holder housing. Nevertheless, operators are reluctant to approach transformer tanks that house live high voltage equipment. Operators also forget to actuate the pressure relief mechanism to bleed any pressure within the transformer such that when the fuse holder is removed from the fuse holder housing, oil from within the interior of the transformer is forced out of the fuse holder housing. After the pressure relief valve has been actuated, the pressure within the tank may increase slightly before an operator has the opportunity to remove the fuse holder from the fuse holder housing. This slight increase in pressure may be sufficient to also cause the dielectric oil to flow out of the fuse holder housing.

Other attempts to prevent the oil from exiting the fuse holder housing include a flapper valve that seals a portion of the fuse holder housing exterior of the tank from a portion of the fuse holder housing within the tank such that when the fuse holder is removed, the flapper valve closes to form a seal and the oil cannot escape from the fuse housing. Such a flapper valve is disclosed in U.S. Pat. No. 5,204,654, the entire disclosure of which is hereby incorporated by reference.

However, the transformer tank is still pressurized with use of the flapper valve device alone, and it is necessary that the operator quickly remove the fuse holder from the fuse housing to prevent the dielectric oil from flowing out of the fuse housing. If the operator does not remove the fuse holder in one quick movement, the oil will flow out of the housing until the operator has sufficiently removed the fuse holder from the housing such that the flapper valve may close. Likewise, when the operator inserts the fuse holder back into the fuse holder housing, because the tank is still pressurized, the oil may again flow out of the housing after the flapper valve has been opened and until the time when the operator has sealed the fuse holder housing with the fuse holder.

Other bayonet-type fuse holder housings include a hole located in the housing that communicates the interior of the tank with the interior of the housing. The hole is located in the portion of the fuse holder housing that is located within the transformer tank and is adjacent to the area of the housing that mounts to the wall of the transformer tank. Thus, when the fuse holder is removed from the fuse holder housing, and the seal between the fuse holder and the fuse holder housing is broken, any pressurized gas within the housing will vent through the hole to atmosphere—so long as the oil level is below the hole.

However, this configuration is problematic because pressurized gas within the housing that is rapidly venting through the hole tends to draw oil from within the transformer tank such that a spray of gas and oil is ejected from the fuse holder housing. This is particularly problematic when the oil commonly expands due to an increase in temperature such that it is directly below the hole in the cylindrical housing. Moreover, the oil level may move above the hole in the housing. Although transformer tanks are intended to be level, on occasion the ground on which the transformer is positioned may settle or move causing the transformer to tip. The transformer may also be improperly positioned such that the hole is located below the oil level in the transformer tank. A tilt angle of 2 or 3 degrees can shift the oil level one inch in some transformer tanks. The oil level may also move above the hole because it expands due to a temperature increase. In this case, a high velocity stream of oil shoots out of the housing when the fuse holder is removed. This is especially problematic because operators and maintenance people often overfill the transformer tank with the dielectric oil.

Accordingly, it is apparent that conventional fuse holder housings that attempt to prevent oil from exiting the transformer through the face holder housing are not easily adaptable to changing conditions. The above-described constraints and problems associated with removing a fuse holder from a fuse holder housing mounted to a transformer tank has created a need for a solution.

SUMMARY

An object of the present invention is to provide a simple apparatus that reduces the amount of dielectric liquid that is ejected from the fuse holder housing when a fuse holder is removed from a fuse holder housing, regardless of the pressure within the transformer to which the housing is mounted and regardless of the dielectric liquid level in the transformer.

The foregoing and other objects are obtained by a fuse housing assembly having a housing for holding a fuse located within a tank having a level of liquid. The housing includes an exterior surface, and a mounting portion by which the housing may be mounted to the tank. The housing includes an inner portion located inside the tank and an outer portion located outside the tank when the housing is mounted to the tank via the mounting portion. A bore extends from the outer portion to the inner portion and is configured to receive a removable fuse assembly that includes the fuse. A vent tube includes a vent path between the bore and a portion of the tank that is above the level of the liquid.

According to another aspect of the present invention, a fuse housing assembly includes a housing having an opening. The housing is mountable to a tank that holds a liquid. The housing is adapted to receive through the opening a removable fuse assembly having a fuse. The fuse is positionable within the tank and under the liquid when the fuse assembly is received by the housing and when the housing is mounted on the tank. The fuse housing assembly also includes vent means fastened to the housing for immediately venting internal pressurized air from within the tank to atmosphere through the housing when a seal between the housing and the fuse assembly is broken.

According to a further aspect of the present invention a fuse housing assembly is at least partially located within a tank. The fuse housing assembly includes a housing for holding a fuse and is at least partially positioned within the tank. The tank holds a liquid, and the housing has a vent channel extending from an exterior surface of the housing located within the tank to an interior surface of the housing. The fuse housing assembly further includes a vent tube located completely within the tank and partially within the liquid. The vent tube extends above the level of the liquid in the tank such that an opening into the tube is located above the liquid and is surrounded by gas in the tank. The vent tube is in liquid communication with the vent channel of the housing.

According to a further aspect of the present invention a fuse housing assembly for a fuse includes a substantially tubular housing. The housing is mountable in a transformer body and has an upper portion and a lower portion. The upper portion is accessible from an area outside of the transformer body. The lower portion of the housing is constructed and arranged to hold the fuse in liquid in the transformer body. The fuse housing assembly includes a snorkel tube for preventing introduction of the liquid into the upper portion of the housing as the fuse is removed.

Still other objects and advantages of the present invention will become readily apparent to those skilled in the art from the following detailed description, where we have shown and described the preferred embodiment of the present invention. As will be realized, the invention is capable of modification in various obvious aspects, all without departing from the present invention. Accordingly, the drawings and description are to be regarded as illustrative in nature, and not limitative.

DETAILED DESCRIPTION OF THE PREFERRED EMBODIMENTS

Figure 1:
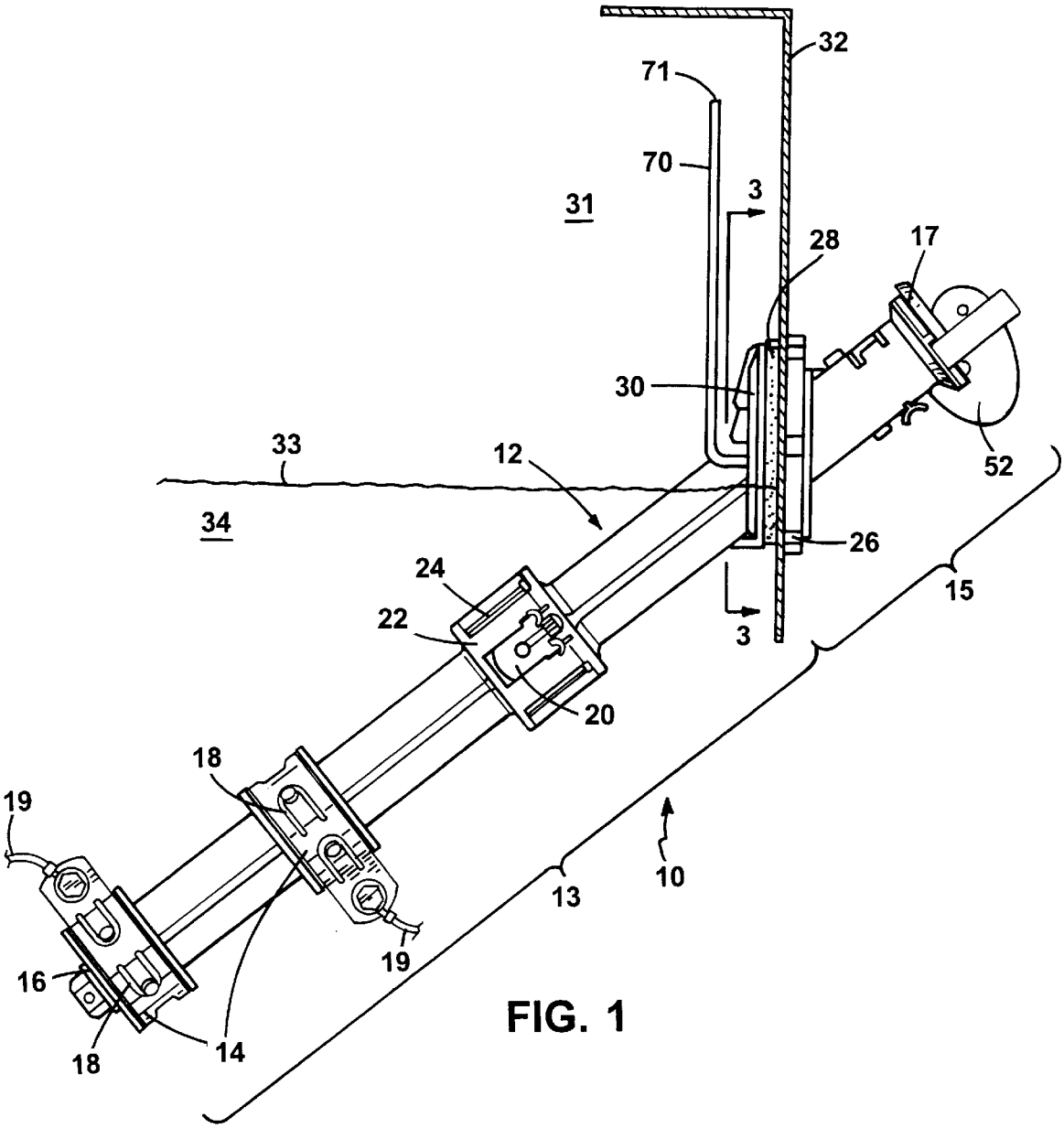
FIG. 1 is a side elevational view of a fuse holder housing assembly according to one embodiment of the present invention in use with a transformer.

FIG. 1 illustrates a fuse holder assembly 10 according to one embodiment of the present invention. The fuse holder assembly 10 includes a fuse holder housing 12 for receiving a fuse holder 40, illustrated in FIG. 2. The fuse holder housing 12 is mountable to an electrical apparatus, such as a transformer tank having a sidewall 32 that holds a dielectric liquid 34 such as an oil. When the fuse holder 40 and the fuse 42 are inserted into the fuse holder housing 12 that is mounted to the transformer tank sidewall 32, the fuse is located under the oil. The fuse holder assembly 10 includes a snorkel or vent tube 70 that communicates the gas above the oil surface 33 in the transformer to the interior 35 of the fuse holder housing. When an operator removes the fuse holder 40 to replace an exhausted fuse 42, a seal formed between the fuse holder 40 and the fuse holder housing 12 is broken, and pressurized gas within the transformer tank will vent through the vent tube 70, through the interior 35 of the fuse holder housing, and out an open end of the fuse holder housing to atmosphere, rather than causing the oil to flow out of the fuse holder housing.

Referring to FIG. 1, shown is a fuse holder assembly 10 according to one embodiment of the present invention. The fuse holder assembly 10 includes a fuse holder housing 12. As illustrated in FIG. 1, the fuse holder housing 12 is mounted to a transformer tank sidewall 32 such that an inner or lower portion 13 of the fuse holder housing 12 is located within the transformer tank and such that an outer or upper portion 15 of the fuse holder housing 12 is located outside the tank. The distal end 16 of the lower portion 13 is open, and the proximal end 17 of the upper portion 15 is open.

Figure 2:
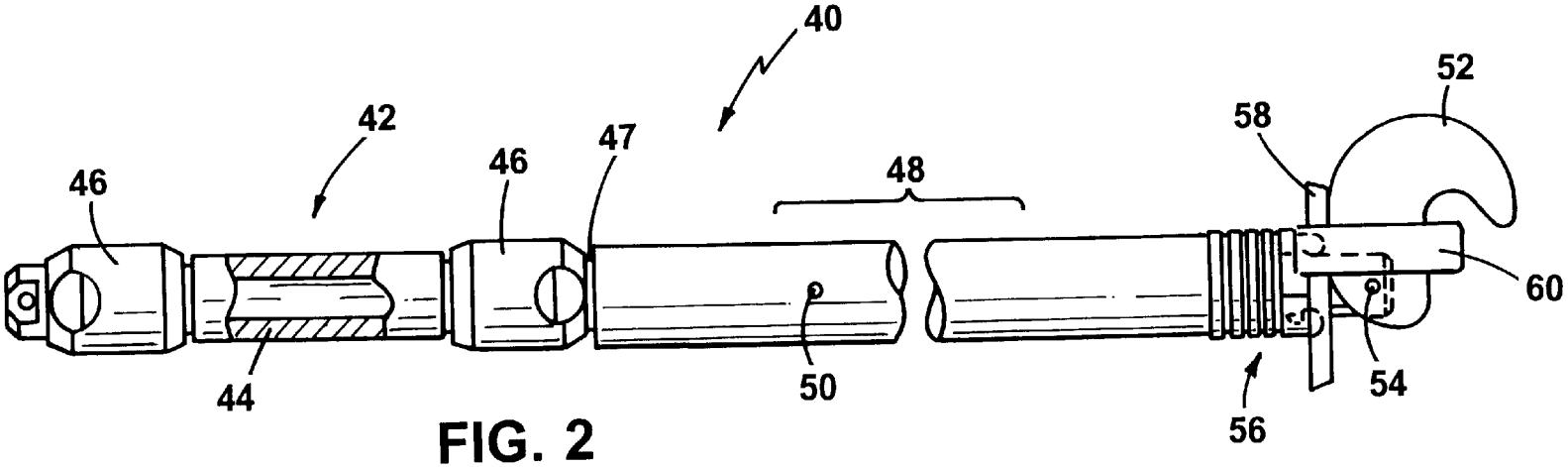
FIG. 2 is a side elevational view of a fuse holder holding a fuse that may be used with the fuse holder housing illustrated in FIG. 1.

The fuse holder housing 12 is for use with a fuse holder 40, such as that illustrated in FIG. 2. The fuse holder housing 12 is generally a cylindrical or tubular housing of electrical insulating material. However, the fuse holder housing 12 could be configured otherwise and still be within the confines of the present invention. For example, the fuse holder housing 12 could be noncircular and nonstraight. The fuse holder housing 12 is configured to receive the fuse holder 40. That is, the fuse holder housing 12 includes an interior 35 into which the fuse holder 40 may be inserted. In FIG. 1, the fuse holder 40 has been completely inserted into the fuse holder housing 12 such that the conductive terminal contacts 46 of the fuse 42 are each in contact with the respective spring loaded contacts 14 near the distal end 16 of the fuse holder housing 12.

The fuse holder housing 12 includes a mounting flange 30 such that the fuse holder housing 12 may be easily mounted to the transformer tank sidewall 32. The mounting flange 30 includes threads that may be inserted through a hole in the transformer tank sidewall 32. A seal member 28 may be inserted over the threads of the mounting flange 30, and a female nut 26 may be threaded to the threads of the mounting flange 30 to mount the fuse holder housing 12 to the transformer tank sidewall 32. Although the mounting flange 30 is used to mount the fuse holder housing 12 to the transformer, the fuse holder housing may be mounted to the transformer with other means, such as screws, bolts, snaps, clips, a press-fit, or other mounting devices that are well-known in the art. The mounting flange 30 is integral with the housing 12, i.e., part of the housing, and forms and angle with respect to the longitudinal axis of the housing. Thus, when the fuse holder housing 12 is mounted to the transformer tank sidewall 32, the fuse holder housing 12 is at an angle with respect to the transformer tank sidewall, such as between 40 and 50 degrees.

Because the mounting flange 30 of the fuse holder housing 12 is located between the distal end 16 and the proximal end 17 of the housing, the housing 12 projects through the sidewall 32 of the transformer, and the mounting flange 30 defines the inner portion 13 and the outer portion 15 of the fuse holder housing. That is, the inner portion 12 extends from the mounting flange 30 to the distal end 16, and the outer portion 15 extends from the mounting flange 30 to the proximal end 17.

As illustrated in FIG. 1, and as is well known in the art, the transformer tank holds a dielectric liquid 34, such as mineral oil. The dielectric liquid 34 acts as a dielectric medium, cools the interior components of the transformer (not illustrated) and is also capable of extinguishing electrical arcs.

The fuse holder housing 12 may be tubular such that it is adapted to receive within its interior the fuse holder 40 illustrated in FIG. 2. The fuse holder 40 is conventionally known, and is inserted into the fuse holder housing 12 through an opening in the open end or proximal end 17. The fuse holder 40 is also removable from the fuse holder housing 12. The fuse holder 40 holds a fuse 42 via an insulating rod 48. The tubular insulating rod 48 of electrical insulating material is for inserting the fuse 42 into its position between the two sets of spring loaded contacts 14.

The fuse 42 includes conductive terminal contacts 46 located at opposing ends of the fuse. The fuse 42 primarily includes a tubular fuse cartridge 44 that is well known in the art having a fusible link located therein (not illustrated). One of the conductive terminal contacts 46 of the fuse 42 is threaded to the insulating rod 48 via a thread connection 47 such that the fuse is held by the insulating rod. That is, the fuse cartridge 44 is suitably mechanically connected to the inner, or distal end of the insulating rod 48 by a male threaded connector 47 adapted to receive a female threaded portion of the fuse 42. The fusible link located within the tubular fuse cartridge 44 melts or vaporizes in response to an over-current or overload condition to initiate a circuit-interrupting operation. In general, the fuse 42 is a safety device that protects an electric circuit from excessive current, consisting of or containing a metal element or other element that melts or vaporizes when current exceeds a specific amperage, thereby opening the circuit.

The fuse 42, when fully inserted into the fuse holder housing 12 is positioned in the lower, distal, or inner area of the housing 12 immediately above the distal end 16. When the fuse holder 40 is inserted into the fuse holder housing 12, the longitudinal axis of the fuse holder housing 12 and the fuse holder 40 are generally coincident. In this position, depicted in FIG. 1, the terminal contacts 46 of the fuse 42 are respectively engaged by the two biased conductive contacts 14 mounted on the fuse holder housing 12. One set of the stationary biased contacts 14 is located near the distal end 16 of the fuse holder housing 12, and the other set 14 is located in a region between the distal end 16 and the mounting flange 30 of the fuse holder housing 12. As shown in FIG. 1, the biased contacts 14 may be electrically connected to the transformer circuitry via the conductors 19, such as braided wire conductors. When the fuse assembly 40 is fully inserted into the fuse holder housing 12, current flows between the conductive terminals of the fuse 42 via the series combination of the conductor wires 19, spring loaded contacts 14, and the fuse 42 itself. Typically, the conductive terminal contacts 46 are connected in series with a primary winding of the transformer so that the fuse 42 protects the transformer against excessive currents, although the fuse 42 and fuse holder assembly may be used with other electrical equipment and still function as contemplated.

When the fuse holder 40 is inserted into the fuse holder housing 12, the insulating rod 48 extends from the fuse 42 up through the interior 35 of inner and outer portions 13, 15 of the fuse holder housing, and carries, at its proximal or upper end, a cap 58. The cap 58 is clamped against the seal member or exemplary bottle-stopper device 56 at the proximal or upper end of the fuse holder 40. Also located at the upper end of the fuse holder 40 is a latch handle 52 and a hook-eye 60 that are integrally formed and are rotatable about the pin 54. The latch handle 52 and the hook-eye 60 are used to compress the bottle-stopper device 56 by forcing the cap 58 towards the bottle-stopper device 56 to thereby cause it to expand. The hook-eye 60 is coupled to the latch handle 52 so as to receive a hot stick for releasing the latch handle 52 and moving the fuse assembly 40. The parts 52, 54, 56, 58, and 60 are of conventional design and operate in a conventional manner to close-off the upper end 17 of the fuse holder housing 12 after the fuse holder 40 has been inserted into the fuse holder housing. That is, when the bottle-stopper device 56 is compressed, it forms a seal between the fuse assembly housing 12 and the fuse holder 40 such that air and liquid generally cannot pass the seal during normal operating conditions of the transformer. The bottle stopper device 56 forms a seal between the outer portion 15 of the fuse holder housing 12 and the fuse holder 40 when the latch handle 52 is rotated to the position illustrated in FIG. 1, i.e., in a clamped position. When the latch handle 52 is in the released position, such as that illustrated in FIG. 2, no seal is formed between fuse holder 40 and the fuse holder housing 12 because the bottle stopper device 56 is no longer compressed by the cap 58. Although the seal formed by the bottle-stopper device 56 is preferred, other devices may be used to form the seal between the fuse holder housing 12 and the fuse holder 40. For example, o-rings, liquid seals, threads, cork devices, and other means are contemplated to form the seal between the fuse holder housing 12 and the fuse holder 40.

Should the fuse 42 be subjected to a load-break condition, such as a short-circuit current or an overload current, the fusible link located within the tubular fuse cartridge 44 will melt or vaporize, creating an electric arc which reacts with the surrounding dielectric liquid 34 and insulating material of the housing 12 and/or fuse holder 40 to develop gases or vapors. These gases or vapors are generally vented from the fuse holder housing 12 through a plurality of openings 24 located in the cage 22. These gases and vapors are also vented through the open end or distal end 16 of the fuse housing 12 located at the lower end of the housing. Any gases that rise through the inner portion 13 of the fuse housing 12 are able to flow into the interior of the insulating rod 48 and exit via the vent hole 50 which is conveniently aligned with the openings 24 in the cage 22. Additionally, there are a series of openings 18 formed in the spring loaded contacts 14. From the above description, it is apparent that the inner portion 13 of the fuse holder housing 12 is generally full of the dielectric liquid 34 such that the fuse 42 is completely submerged in liquid when the level 33 of dielectric liquid 34 in the transformer tank is above the fuse 44.

When it is desired to withdraw the fuse holder 40 from its fully inserted position illustrated in FIG. 1, the latch handle 52 and hook-eye 60 are rotated such that the seal formed by the bottle-stopper device 56 is broken and the fuse holder 40 may be removed from the fuse holder housing 12 by pulling the fuse holder 40 outwardly away from the fuse holder housing 12 and transformer tank sidewall 32. Because many of the components within the transformer are still "live," this step is usually completed with the assistance of a hot stick, as is well-known in the art.

However, when the seal is broken upon actuation of the latch handle 52 from the closed position illustrated in FIG. 1 to the open position illustrated in FIG. 2, conventional fuse holder housings 12 permit the dielectric liquid 34 to flow from the interior portion 13 to the outer portion 15, eventually out of the fuse holder housing 12. To address this problem, the present invention provides for venting of the high pressure gases within the transformer tank to atmosphere as soon as the seal is broken. That is, the present invention allows gases that are at a pressure higher than atmospheric pressure at the location where the fuse holder assembly 10 is located to vent from the transformer when the seal formed by the bottle stopper device is broken. This is carried out by a snorkel or vent tube 70, such as that illustrated in FIGS. 1 & 4.

The vent tube 70 prevents the introduction of the dielectric liquid 34 into the upper or outer portion 15 of the fuse holder housing 12 as the fuse holder 40 is removed from the housing. The vent tube 70 communicates an interior area of the transformer tank devoid of liquid in the transformer tank, specifically the area 35 of the transformer tank that is above the oil level 33, with an area exterior of the transformer via the interior of the fuse holder housing 12. Thus, the fuse holder housing 12 communicates the exterior environment with the vent tube 70 when the latch handle 52 is released to break the seal between the fuse housing and the fuse holder.

Figure 4:
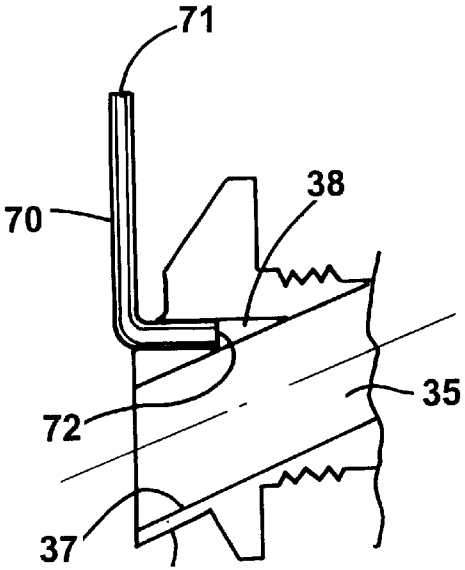
FIG. 4 is a partial sectional view taken along the line 4—4 of FIG. 3, with a vent tube positioned in a vent channel.
Figure 3:
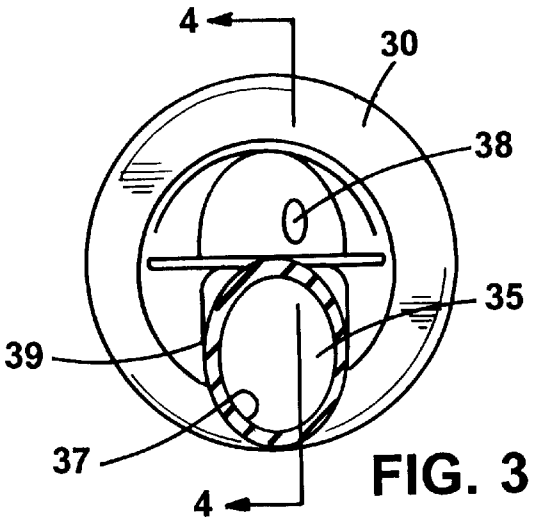
FIG. 3 is a partial sectional view taken along the line 3—3 of FIG. 1, but without a vent tube positioned in a vent channel.

The high pressure gases within the transformer are vented from the transformer via the vent tube 70 and the vent channel 38 located through the exterior surface 15 of the fuse holder housing 12. As illustrated in FIGS. 3 and 4, the vent channel 38 is a cylindrical bore that extends from the exterior surface 39 of the fuse holder housing 12 to the interior surface 37. The vent channel 38 communicates the exterior of the fuse housing 12 with the interior of the fuse housing, specifically the cylindrical bore 35. In the embodiment of the present invention illustrated in FIG. 1, the vent channel 38 is located approximately near the mounting flange 30 of the fuse holder housing 12. It is preferred that the vent channel 38 be located on the inner portion 13, and on the upper side of the fuse holder housing 12. That is, it is preferable that the vent channel 38 be located closer to the mounting flange 30 than the distal end 16 such that any liquid 34 within the fuse holder housing 12 is below the vent channel 38 during most operating conditions.

As illustrated in FIG. 1, the level 33 of the dielectric liquid 34 may extend above the mounting flange 30 of the fuse holder housing 12. In most instances, however, the dielectric liquid level 33 will be located below the mounting flange 30, but above the uppermost contact 14 nearest to the mounting flange 30. As illustrated in FIG. 1, the vent tube 70 communicates the gas above the level 33 of the dielectric liquid 34 to the cylindrical bore 35 in the fuse holder housing 12. Thus, when an operator actuates or releases the latch handle 52 so as to break the seal formed by the bottle-stopper device 56, rather than the high pressure gas within the transformer tank causing the dielectric liquid within the fuse holder housing 12 to jet or flow out of the fuse holder housing toward the operator, the high pressure gas will follow the easier path of less resistance through the vent tube 70, through the cylindrical bore 35, and out the outer open end 17 of the fuse holder housing 12. In this manner, the interior of the vent tube 70 acts as a vent path between the interior bore 35 and the area 31 of the transformer tank that is above the level 33 of the dielectric liquid. That is, the vent tube 70 acts as a snorkel or vent means fastened to the housing for immediately venting internal pressurized air from within the tank to atmosphere through the housing when a seal between the housing 12 and the fuse holder 40 is broken.

Thus, the vent tube 70 includes two open ends 71, 72. The first open end 71 is located above the level 33 of the dielectric liquid 34 such that it is in communication with the gas within the tank. The second end 72 of the tube 70 opens into the cylindrical bore 35 of the fuse holder housing 12. For example, as illustrated in FIG. 4, the second end 72 of the tube 70 is positioned in the vent channel 38 such that the vent tube is in liquid communication with the vent channel 38 of the fuse holder housing 12. It is preferred that the vent tube 70 does not overly extend into the bore 35 such that it does not interfere with the removal and injection of the fuse holder 40.

In the embodiment illustrated in FIG. 4, the vent tube 70 has been press-fit in a interference-fit fashion into the vent channel 38. Thus, at least a portion of the vent tube 70 is received by the vent channel 38. In general, the second end 72 of the vent tube 70 is in sealing communication with the vent channel 38 such that the first end 71 of the vent tube 70 is in liquid communication with the bore 35. The vent tube 70 may also be attached, fixed, glued, connected, snapped, clipped, threaded or simply inserted into the housing 12 by any variety of devices or methods well known in the art so long as the vent tube 70 directly communicates the area 31 above the dielectric liquid level 33 with the interior of the fuse holder housing assembly 12.

Although the vent tube 70 is in communication with the cylindrical bore 35 of the fuse holder housing 12 by via the vent channel 38, the vent tube 70 may be in communication with the cylindrical bore via other means. For example, a long nipple may be molded to the housing 12 that communicates the exterior of the housing with the bore 35. The vent tube 70 may be slid over the nipple to communicate the gas in the transformer with the bore 35 of the housing. Additionally, the vent tube 70 need not be one piece. Multiple tubes may be connected in series or in parallel to vent pressurized gas from the transformer through the fuse holder housing 12 when the seal between the fuse holder housing 12 and the fuse holder 40 is broken. Although the vent tube 70 is illustrated as a cylindrical tube, the vent tube may be other configurations all within the confines of the present invention. For example, the vent tube may have a rectangular, triangular or other differently shaped cross-section, and may be a channel, conduit, duct, pipe, nozzle, airway or other ventiduct device that communicates the area 31 above the liquid 34 with the interior of the fuse holder housing 12.

In the example illustrated in FIG. 4, the vent tube 70 preferably communicates the gas with the cylindrical bore 35 at a location near or immediately adjacent to the mounting flange 30. The vent tube 70 is located completely within the transformer tank and partially within the dielectric liquid 34. The vent tube 70 extends above the level 33 of the dielectric liquid 34 in the tank such that the first opening 71 into the tube is located above the dielectric liquid 34 and is surrounded by gas in the transformer tank.

The vent tube 70 is sufficiently long to extend above the dielectric liquid level 33. Thus, the necessary length of the vent tube 70 necessarily depends upon the dielectric liquid level 33 in the transformer and upon the mounting location of the fuse holder housing 12.

As illustrated in the embodiment of the present invention illustrated in FIG. 1, the vent tube 70 includes a ninety degree bend. That is, the vent tube 70 extends away from the fuse holder housing 12 such that is generally perpendicular to the transformer tank sidewall 32, and then bends vertically upward to a position parallel with the transformer tank wall. The vent tube 70 is formed from a material that is flexible, such as plastic or soft copper but is preferably, sufficiently stiff or self-supporting to hold the first opening 71 above the dielectric liquid level 33. Alternatively, the vent tube 70 may be formed from a rigid material, such as a molded plastic. However, it is preferred that the vent tube 70 be bendable such that if transformer components or other items obstruct the path of the tube directly to the gas above the dielectric liquid 33, the tube may be easily bent around the obstruction. Furthermore, with such a bendable vent tube 70, one length tube may be supplied for different applications, permitting the tube to be cut to length and/or bent to fit the particular application.

Although the vent tube 70 illustrated in FIG. 1 is self supporting, the vent tube 70 may also be flexible such that the tube will not support its own weight, i.e., will not support the first opening 71 above the dielectric liquid level 33. In this case, the vent tube 70 may be formed of a flexible hose and mounted to the side of the transformer tank or other item such that the first open end 71 is located above the liquid surface 33.

The diameter of the vent tube 70 depends upon the amount of time needed to vent the pressurized gases from within the transformer. According to one embodiment, the vent tube 70 has an outer diameter of approximately ¼ inch.

According to one embodiment of the present invention, the fuse holder housing 12 also includes a flapper valve 20, such as that described in the background of the present application. The flapper valve 20 is well known, and is described in detail in U.S. Pat. No. 5,204,654. In general, when the fuse 42 and the fuse holder 40 are inserted into the fuse holder housing 12, an arm of the flapper valve is forced away from a stopper opening in the bore 35 allowing the fuse to pass there through. During normal operation, the flapper valve is held in an open position by the fuse holder 40. When the fuse and the fuse holder 40 are removed from the fuse holder housing 12, the flapper valve closes and seals the stopper opening, preventing any more oil from draining through the upper portion 15 of the fuse holder housing. When used in conjunction with the vent tube 70, an operator can be virtually assured that very little, if any, liquid 34 will flow out of the fuse holder housing 12 and escape the transformer tank when the seal between the fuse holder housing 12 and the fuse holder 40 is broken.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit and scope of the present invention. Accordingly, it is expressly intended that all such variations, changes and equivalents fall within the spirit and scope of the present invention as defined in the claims embraced thereby.

We claim:

1. A fuse housing assembly comprising:

a housing for holding a fuse located within a tank having a level of liquid, said housing having:

an exterior surface, a mounting portion by which said housing may be mounted to the tank, said housing having an inner portion located inside the tank and an outer portion located outside the tank when said housing is mounted to the tank via said mounting portion, a bore extending from said outer portion to said inner portion and configured to receive a removable fuse assembly that includes the fuse; and a vent tube having a vent path between the bore and a portion of said tank that is above the level of said liquid.

2. The fuse housing assembly according to claim 1, further comprising a vent channel communicating an exterior surface of said inner portion with said bore.

3. The fuse housing assembly according to claim 2, wherein said vent tube includes a first end and a second end, said second end in sealing communication with said vent channel such that said first end of said vent tube is in liquid communication with said bore.

4. The fuse housing assembly according to claim 2, wherein said vent channel is adjacent to said mounting portion.

5. The fuse housing assembly according to claim 1, further comprising a vent channel communicating an exterior surface of said inner portion with said bore, wherein a portion of said vent tube is positioned in said vent channel.

6. A fuse housing assembly comprising:

a housing having an opening and being mountable to a tank that holds a liquid, said housing sized to receive through said opening a removable fuse assembly having a fuse, said fuse being positionable within the tank and under the liquid when said fuse assembly is received by said housing and when said housing is mounted on said tank; and vent means fastened to said housing to immediately vent internal pressurized air from within the tank to atmosphere through said housing when a seal between said housing and the fuse assembly is broken.

7. The fuse housing assembly according to claim 6, wherein said vent means includes a vent tube.

8. The fuse housing assembly according to claim 7, wherein said housing includes a vent channel, said vent tube fastened to said housing via an interference fit between said vent tube and said vent channel.

9. The fuse housing assembly according to claim 6, wherein said opening of said housing is into a bore in said housing.

10. A fuse housing assembly at least partially within a tank, comprising:

a housing for holding a fuse and at least partially positioned within a tank holding a liquid, said housing having a vent channel extending from an exterior surface of said housing located within said tank to an interior surface of said housing;

a vent tube located completely within said tank and partially within said liquid, said vent tube extending above a level of said liquid in said tank such that an opening into said tube is located above said liquid and is surrounded by gas in said tank, said vent tube in liquid communication with said vent channel of said housing.

11. The fuse housing assembly according to claim 10, wherein said housing includes a vent channel, said vent tube in liquid communication with said vent channel.

12. The fuse housing assembly according to claim 10, wherein said housing includes an inner portion located within said tank and an outer portion located outside said tank, said inner portion at least partially submerged in said liquid.

13. A fuse housing assembly for a fuse, said fuse housing assembly comprising:

a substantially tubular housing, said housing mountable in a transformer body and having an upper portion and a lower portion, said upper portion accessible from an area outside of said transformer body, said lower portion of said housing being constructed and arranged to hold said fuse in liquid in said transformer body;

a snorkel tube for preventing introduction of said liquid into said upper portion of said housing as said fuse is removed said snorkel tube communicating an interior of said tubular housing with an area within the transformer body and exterior of said tubular housing.

14. The fuse housing assembly according to claim 13, said tubular housing including a vent channel communicating an exterior surface of said substantially tubular housing with an interior of said housing, said snorkel insertable into said vent channel.

* * * * *

UNITED STATES PATENT AND TRADEMARK OFFICE
Certificate

Patent No. 5,936,507 Patented: August 10, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Gordon Thomas Borck, Waukesha, Wisconsin; William Beitz, Waukesha, Wisconsin; Allen LeRoy Johnson, Mukwonago, Wisconsin; and Theodore Joseph Van Lankvelt, Elm Grove, Wisconsin.

Signed and Sealed this Twenty-sixth Day of February 2002.

DARREN SCHUBERG
*Supervisory Patent Examiner*
Art Unit 2835